United States Patent [19]

Frasher

[11] 4,136,899

[45] Jan. 30, 1979

[54] DOOR BRACE

[76] Inventor: Gary J. Frasher, G-1348 W. Carpenter, Flint, Mich. 48505

[21] Appl. No.: 915,392

[22] Filed: Jun. 14, 1978

[51] Int. Cl.[2] ..... E05C 17/50

[52] U.S. Cl. ..... 292/338; 292/DIG. 15

[58] Field of Search ..... 292/DIG. 5, 338, 262, 292/271, 263, 268, 273, 269; 70/94; 248/354 S

[56] References Cited

U.S. PATENT DOCUMENTS

| | | | |
|---|---|---|---|
| 1,304,394 | 5/1919 | Shyer | 292/338 |
| 1,943,826 | 1/1934 | Holtzman | 292/338 X |
| 1,944,783 | 1/1934 | Ciriacy et al. | 292/338 |
| 3,239,261 | 3/1966 | Bryson et al. | 292/DIG. 15 |
| 3,989,286 | 11/1976 | Cleff | 292/DIG. 15 X |
| 4,019,765 | 4/1977 | Nichola | 292/338 |
| 4,076,293 | 2/1978 | Valles | 292/338 |

*Primary Examiner*—J. Franklin Foss

*Attorney, Agent, or Firm*—Gifford, Chandler, VanOphem, Sheridan & Sprinkle

[57] ABSTRACT

A door brace is provided for use in conjunction with a door having a door knob, the rotation of which permits the door to open. The door brace comprises a first elongated member having its upper end mounted to the door knob and a second elongated member telescopically received within the first member and movable between an extended, ground engaging position and a retracted, inoperative position. A spring under tension is connected between the first and second members and urges the second member from its extended to its retracted position. A lock retains the second member in its extended position and is connected to the door knob so that upon rotation of the knob, the lock is released thus permitting the second member to move from its extended to its retracted position.

10 Claims, 7 Drawing Figures

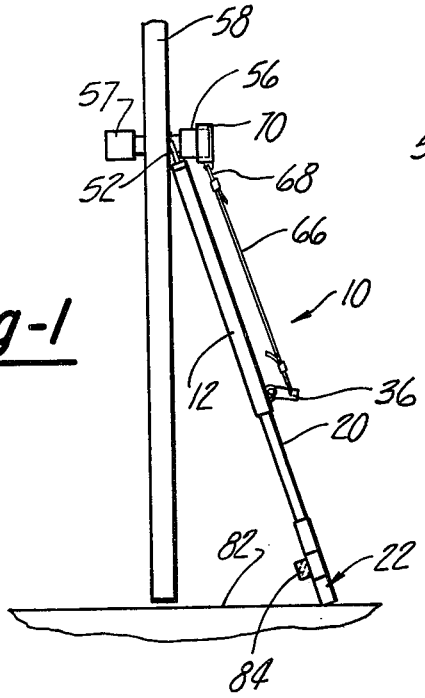
Fig-1
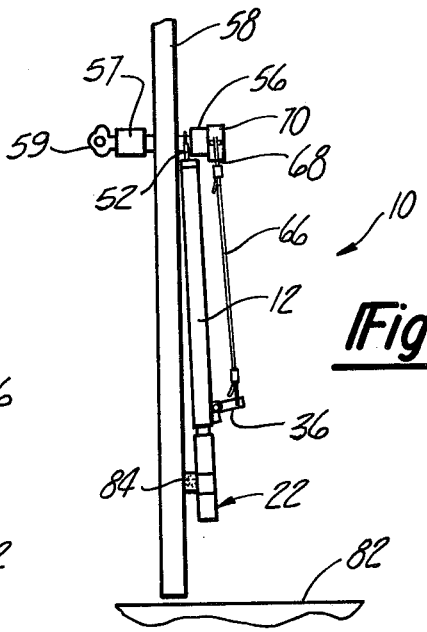
Fig-2
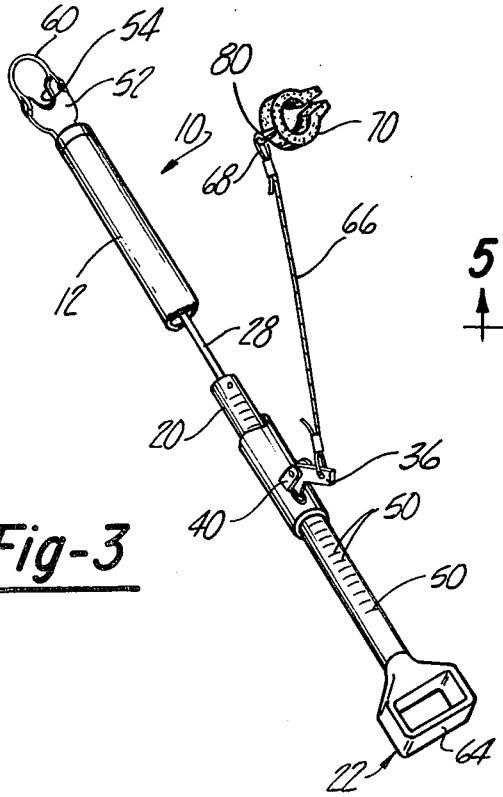
Fig-3
Fig-4
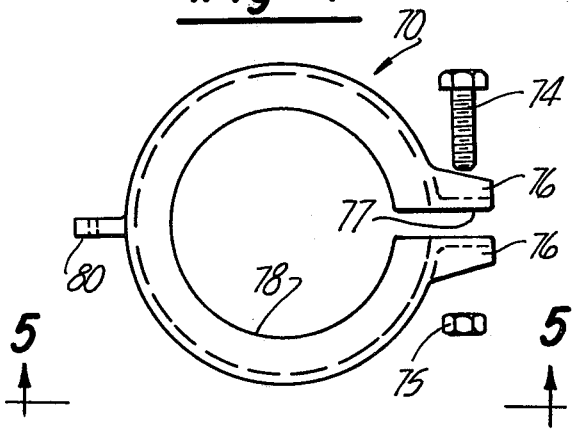
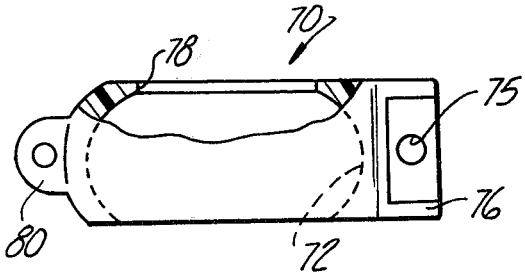
Fig-5

DOOR BRACE

BACKGROUND OF THE INVENTION

I. Field of the Invention

The present invention relates generally to security devices and, more particularly, to a door brace which can be released exteriorly of the door.

II. Description of the Prior Art

Doors of the type used in office buildings, homes, apartments, and the like typically have a door knob, the rotation of which permits the door to be opened. In order to prevent unauthorized entry into the dwelling, a key operated lock is included within the door knob which prohibits the rotation of the door knob except upon insertion of the proper key. Moreover, door locks are now commercially available which are virtually "pick-proof" by the average burglar or intruder.

Less imaginative intruders, however, have overcome the problem of locked doors by forcing the doors open with a crowbar or similar instrument. This method effectively bypasses the lock in the door knob and normally damages and/or breaks the door jamb in the process.

There have been a number of previously known door braces which engage the interior side of the door and brace the door against a forced entry. Moreover, many of these previously known door braces are releasable exteriorly of the door upon the insertion and rotation of the proper key in the door lock.

These previously known door braces, however, have not enjoyed widespread commercial acceptance or use for a number of reasons. One reason is that these previously known door braces are cumbersome, unsightly and expensive in construction. Moreover, these previously known door braces oftentimes malfunction and prevent entry through the door even by authorized persons. Also special tools and experienced installers are often required to install the braces.

SUMMARY OF THE PRESENT INVENTION

The present invention overcomes the above-mentioned disadvantages of the previously known door braces by providing an exteriorly releasable door brace for protection against forced entry which can be installed by relatively unskilled workmen with simple tools and which is simple and inexpensive in construction and yet totally effective in use.

In brief, the door brace according to the present invention comprises a first elongated tube having its upper end secured to the door and preferably around the door knob. A second elongated member is slidably and telescopically received within the other end of the first elongated member while a spring connected between the first and second members urges the second member from an extended to a retracted position. A stop is secured to the free end of the second member in its extended position. Conversely, with the second member in its retracted position, the stop is moved out of engagement with the floor so that the door brace is released or rendered inoperative.

A lock means retains the second member in its extended position and is connected to and actuated by a cord secured at one end to the door knob. Thus, in those types of door knobs where rotation of the exterior knob also rotates the inner knob upon unlatching of the door and rotation of the exterior door knob, the lock means opens and permits the second member to move to its retracted or inoperative position.

BRIEF DESCRIPTION OF THE DRAWINGS

A better understanding of the door brace according to the present invention will be had upon reference to the following detailed description when read in conjunction with the accompanying drawing, wherein like reference characters refer to like parts throughout the several views, and in which:

FIG. 1 is a side plan view illustrating the door brace of the present invention secured to a door and in its operative position;

FIG. 2 is a side plan view of the door brace of the present invention similar to FIG. 1, but showing the door brace in its inoperative position;

FIG. 3 is a fragmentary perspective view illustrating the door brace of the present invention and with parts removed for clarity;

FIG. 4 is a front plan view illustrating one component of the door brace of the present invention;

FIG. 5 is a side plan view taken substantially along line 5—5 in FIG. 4;

DETAILED DESCRIPTION OF THE INVENNTION

Figure 6:
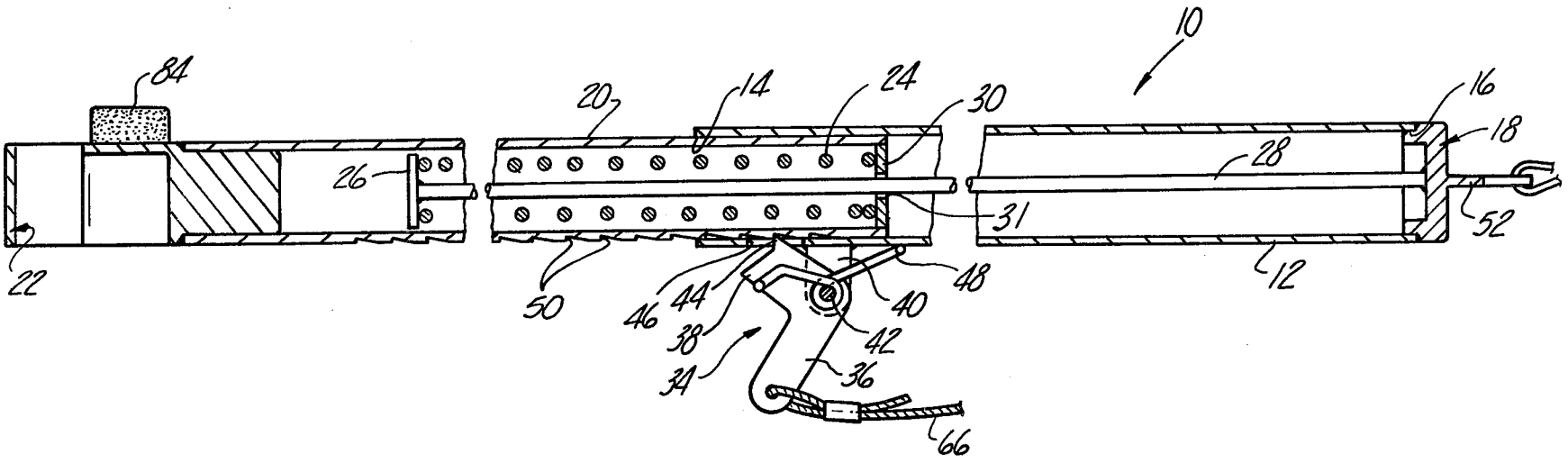
FIG. 6 is a fragmentary cross-sectional view illustrating the door brace of the present invention.

With reference first to FIGS. 3 and 6, the door brace 10 according to the present invention is thereshown and comprises a first elongated tubular member 12 which as can be seen in FIG. 6 has one open end 14 and its other end 16 closed by a cap 18. A second elongated tubular member 20 is axially slidably attached to the first member 12 and preferably is telescopically received through the open end 14 of the first member 12. A stop 22, the construction and operation of which will be later described in detail, is secured to the free end of the second member 20.

Referring to FIG. 6 the end of the tubular member 20 opposite the stop 22 is provided with a closure member 30 having an aperture 31. A rod 28 secured at one end to a cap 18 extends through this tubular member 12, through the aperture 31 and into the tubular member 14. A stop 26 is mounted to the free end of the rod 28. A helical spring 24 is biased between the stop 26 and the closure member 30 to resist extension of the tubular members 12 and 20. The helical spring 24 is in a state of compression so that the spring 24 urges the second member 20 axially into or toward the first member 12. As best shown in FIG. 6, the spring 24 is preferably coaxially disposed about the rod 28 and contained within the interior of the second tubular member 12. It will be understood, however, that other resilient means can also be employed to resiliently urge the second member 20 toward and into the first tubular member 12 while remaining within the spirit of the invention.

Still referring to FIG. 6, latching means are provided in the form of an L-shaped catch 34 having a long arm 36 and a short arm 38 pivotally mounted around a pin 42 to the lower end of the first member 12 by a bracket 40. A point 44 on the end of the short arm 38 extends through an axial slot 46 in the first member 12 while a spring 48 wrapped around the pin 42 and engaged with the catch 34 urges the point 44 through the slot 46 and against the outer periphery of the second member 20.

A plurality of axially spaced circumferential indentations 50 are preferably formed along one side of the second tubular member 20 so that the indentations 50 register with and pass underneath the slot 46 as the second member 20 is moved from its retracted to its extended position and vice versa. The point 44 on the catch 34 cooperates with the indentations 50 so that the point 44 can engage any one of the indentations 50 and axially lock the position of the second member 20 relative to the first member 12. The catch 34 thus prevents the retraction of the second member 20 into the first member 12 from the force of the helical spring 24. Conversely, with the point 44 moved out of contact with any indentation 50, the second member 20 retracts into the first member 12.

Figure 7:
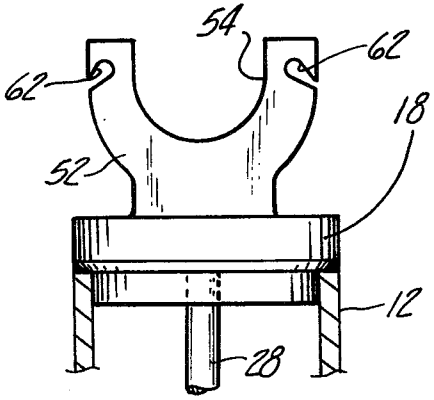
FIG. 7 is a plan view illustrating another component of the door brace according to the present invention.

With reference now to FIGS. 1, and 3, the cap 18 preferably includes an outwardly extending yoke 52 with an arcuate channel 54. As can best be seen in FIGS. 1 and 2, the yoke 52 is adapted to be positioned underneath the neck of a door knob 56 on a door 58 so that the door knob neck is received within the arcuate channel 54. A strap 60 (FIG. 3) extends over and around the door knob 56 and is secured at each end to each arm of the yoke 52 to thereby secure the yoke 52 to the door knob 56. The strap 60 can be constructed of any conventional material and is secured to the yoke 52 in any conventional fashion, such as by loops (not shown) on the end of the strap 60 engaging locking grooves 62 (FIG. 7) on each arm 54 of the yoke 52.

With reference now to FIG. 3, the stop 22 at the free end of the second tubular member 20 can take any conventional shape but, as shown, is preferably in the form of a loop having a relatively wide bottom surface 64. The loop construction of the stop 22 reduces the overall weight of the door brace 10 without sacrifice of operation as will become hereinafter apparent.

With reference now to FIGS. 1–3, a cord 66 is secured at one end 67 to the free end of the long arm 36 of the catch 34 and at its other end 68 is secured to the door knob 56 so that the upper end of the cord 66 rotates in unison with door knob 56.

The means for allotting the cord 66 to the door knob 56 is best shown in FIGS. 3, 4 and 5 and comprises a cap 70 having an interiorly formed portion 73 contoured to fit over and around the door knob 56. The cap 70 is preferably constructed of a resilient material so that it will when mounted in place conform to the exterior surface of the door knob 56 and so that it will not damage or scratch the door knob 56. As best seen in FIG. 4, a threaded fastener 74 extends through apertures 75 in radially projecting portions 76 formed on each side of a radial slot 77 so that as the threaded fastener 74 is tightened onto a nut 75, the slot 78 is narrowed whereby the cap rim 72 firmly grips the outer periphery of the door knob 56. A radial extension 80 from the cap rim 70 provides the connection point for the upper end 68 of the cord 66. A circular opening 78 is provided in the top of the cap 70 to accommodate the interior locking means (not shown) commonly provided as a part of door knobs.

It will, however, be understood that other means for securing the upper end 68 of the cord 66 to the door knob 56 can also be employed while remaining within the scope and spirit of the invention.

The operation of the door brace 10 can best be described with particular reference to FIGS. 1 and 2. In FIG. 1, the upper end of the first elongated member 12 is secured by the yoke 52 and the loop 60 to the neck of the door knob 56 on the interior side of the door 58 while the cord 66 is attached to the door knob 56 by the cap 70. The second member 20 is extended from the first member 12 so that the bottom surface 64 of the stop 22 engages a ground support surface or floor 82. Simultaneously, the point 44 on the catch 34 engages on indentation 50 in the second member 20 and prevents its retraction into the first member 12.

With the door brace 10 in the position illustrated in FIG. 1, and opening movement of the door 58 being to the right the relatively wide bottom surface 64 of the stop 22 engages the floor 82 and effectively braces the door 58 against forced entry. Cooperating grooves or the like (not shown) can also be formed in the floor 82 to further enhance the bracing action of the door brace 10. Moreover, it can be seen that with the second member 20 in its extended position and with the door 58 open, the door 58 can still be closed which will simply drag the stop 22 along the floor 82 and to its bracing position.

With reference now to FIG. 2, upon authorized entry of the door 58, rotation of the door knob 57 exteriorly of the door 58 by use of a key 59 will rotate the interior door knob 56 to move the cord 66 slightly upwardly due to its rotation with the door knob 56 via the cap 70. This action in turn pivots the catch 34 and moves the point 44 out of engagement with the indentation 50 in the second member 20 which releases the lock and permits the helical spring 24 retract the second member 20 upward into the first member 12. In doing so, the stop 22 is moved out of engagement from the floor 82 and the door brace 10 becomes inoperative and swings against the door 58 (FIG. 2). A bumper 84 is also preferably attached to the stop 22 in order to prevent damage to the door 58 as the door brace 10 swings from the position shown in FIG. 1 to the position shown in FIG 2.

From the foregoing, it can bre seen that the door brace 10 of the present invention provides a simple, inexpensive, and yet totally effective door brace to prevent unauthorized forced entry of the door 58 and which is releasable exteriorly of the door 58. Moreover, unlike the previously known devices of this type, the door brace 10 of the present invention can be easily and rapidly removed from the door knob 56 when its use is not required or desired. Lastly, due to the positive action of the springs, the door brace 10 of the present invention is virtually fail-safe in operation.

Having described my invention, however, many modifications thereto will become apparent to those skilled in the art to which it pertains without deviation from the spirit of the invention as defined by the scope of the appended claims.

I claim:

1. A device for use in conjunction with a door having a door knob, the rotation of which permits said door to open, said device comprising:

a first elongated member having one end attached to said door, a second elongated member slidably attached to said first member and movable between an extended position wherein said second member abuts a ground support surface and braces the door against unauthorized entry and a retracted position wherein said second member is free of said ground support surface permitting said door to be opened, resilient means for urging said second member from said extended position to said retracted position, locking means for retaining said second member in said extended position, and means responsive to the rotation of said door knob means for unlocking said locking means to permit said members to move to said retracted position.

2. The invention as defined in claim 1 wherein at least one of said members is tubular and wherein the other member is telescopically received within the other of said members.

3. The invention as defined in claim 1 wherein said locking means further comprises a catch pivotally secured to one of said members and movable between a locking and nonlocking position, said catch being adapted to lockingly engage means formed on the other member in said locking position to retain said member in an extended position, and resilient means for urging said catch to said locking position.

4. The invention as defined in claim 3 wherein said unlocking means comprises an elongated flexible member, means for securing one end of said flexible member to said door knob and means for securing the other end of said flexible member to said catch whereby rotation of said door knob pivots said catch from said locking position to said unlocking position via said flexible member.

5. The invention as defined in claim 4 wherein said catch is L-shaped and pivotally mounted at its corner, the flexible member is secured to the free end of one arm of said L-shaped catch while the free end of the other arm of the catch engages the locking engagement means formed on the other member.

6. The invention as defined in claim 1 and including a stop secured to the free end of said second member for engaging said surface.

7. The invention as defined in claim 6 wherein said stop has a relatively wide lower surface.

8. The invention as defined in claim 1 wherein said end of said first member is attached around the door knob.

9. The invention as defined in claim 8 wherein said end of said first member is removably attached around the door knob.

10. The invention as defined in claim 1 wherein said resilient means is a helical spring.

* * * * *

UNITED STATES PATENT AND TRADEMARK OFFICE

CERTIFICATE OF CORRECTION

PATENT NO. : 4,136,899

DATED : January 30, 1979

INVENTOR(S) : Gary J. Frasher

It is certified that error appears in the above-identified patent and that said Letters Patent are hereby corrected as shown below:

Column 4, line 6, delete "on" and insert --one-- therefor;

Column 4, line 29, insert --to-- after 24 therefor;

Column 4, line 38, delete "bre" and insert --be-- therefor.

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*